United States Patent [19]

Berton

[11] Patent Number: 4,690,410

[45] Date of Patent: Sep. 1, 1987

[54] WORD FORMING TILE GAME

[75] Inventor: Andrew S. Berton, Potts Point, Australia

[73] Assignee: Incomm Direct Pty. Ltd., State of Victoria, Australia

[21] Appl. No.: 890,288

[22] Filed: Jul. 29, 1986

Related U.S. Application Data

[62] Division of Ser. No. 706,628, Feb. 28, 1985, abandoned.

[51] Int. Cl.[4] ..... A63F 1/00

[52] U.S. Cl. ..... 273/299; 273/294

[58] Field of Search ..... 273/272, 299

[56] References Cited

U.S. PATENT DOCUMENTS

| | | | |
|---|---|---|---|
| 627,046 | 6/1899 | Buttgenbach | 273/299 |
| 912,547 | 2/1909 | Edwards | 273/299 X |
| 1,377,327 | 5/1921 | Ebert | 273/299 |
| 3,565,439 | 2/1971 | Krouse et al. . | |
| 4,416,455 | 11/1983 | Munson et al. . | |

FOREIGN PATENT DOCUMENTS

| | | |
|---|---|---|
| 911228 | 5/1954 | Fed. Rep. of Germany . |
| 1218589 | 12/1959 | France . |
| 484259 | 5/1938 | United Kingdom . |
| 816076 | 7/1959 | United Kingdom . |

*Primary Examiner*—Anton O. Oechsle

*Attorney, Agent, or Firm*—Birch, Stewart, Kolasch & Birch

[57] ABSTRACT

A word game has a set of tiles each formed on one face with a letter and the frequency of occurrence of the letters in the set corresponds to that occurring in the American language. Rules are provided by which a word formed by a player during the progress of the game is taken by the player but may subsequently be taken by another player who incorporates that word into another word. The tiles may be kept in alignment by interlocking formations along their side edges or by fitting them into a rectangular slot in a playing frame.

3 Claims, 3 Drawing Figures

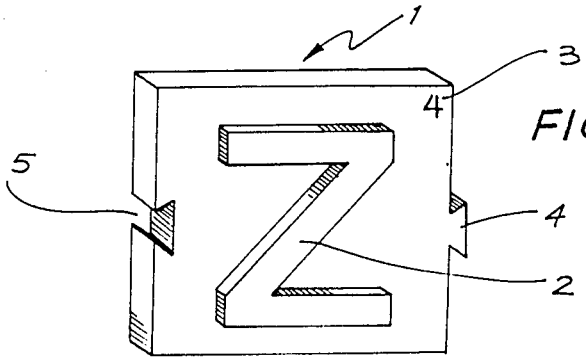
FIG. 1
FIG. 2
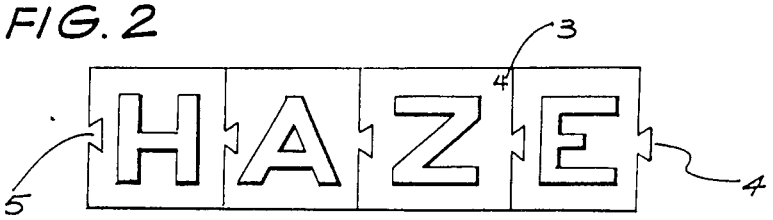
FIG. 3
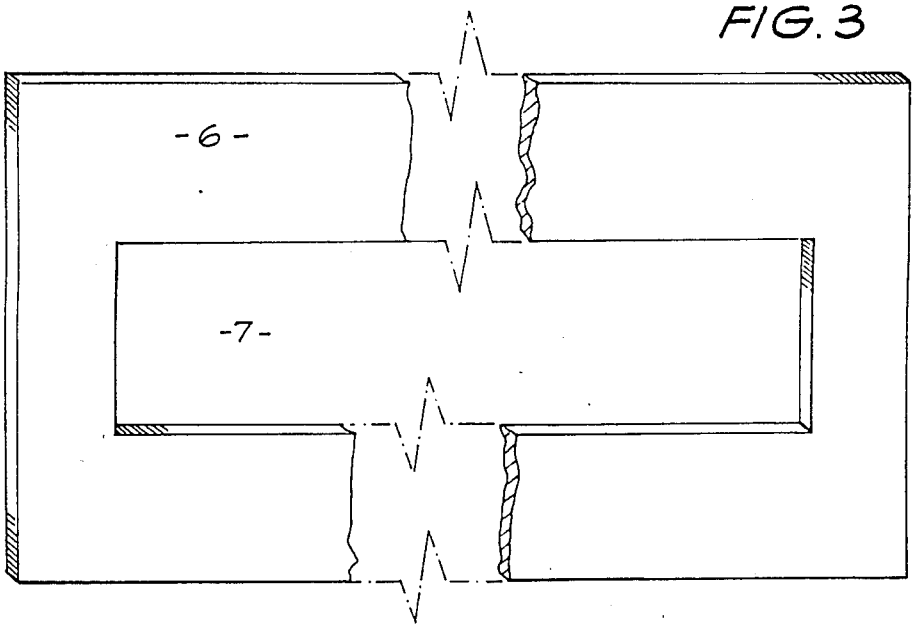

WORD FORMING TILE GAME

This is a division of application Ser. No. 706,628, filed Feb. 28, 1985 and now abandoned.

FIELD OF THE INVENTION

This invention relates to an improved game and, in particular, to an improved word building game.

STATE OF THE ART

Word building games per se are known and have been used in the nursery in an unstructured form for, possibly, centuries.

At the present time one of the more common word building games is "Scrabble" (Registered Trade Mark) in which tiles bearing letters are placed on a board to form a crossword type of arrangement, the scoring depending partially on arbitary values given to the letters themselves and partially upon the actual location of the board. Another well-known word game is "Boggle" (Trade Mark).

Scrabble is, generally, a satisfactory game but does have restrictions, not the least of which is the necessity to have a board upon which it can be played and a further restriction is that, apart from a player being able to use one letter of a word upon the broad, when making a crossword, or a word on the board as a root for a further word, the words, once placed on the board are effectively static.

OBJECT OF THE INVENTION

It is the object of the present invention to provide a word game in which each player has, at all times, the option to use the letters of words which have already been played and which is very much more fluid and quicker in playing than games generally herebefore known.

SUMMARY OF THE INVENTION

The invention, in its broadest sense, includes a game played with tiles or elements, each of which bears a letter on one surface, each player initially having a number of tiles which are sequentially placed, by the players, on the playing surface face upwardly, any player capable of making a word of at least three letters from the tiles on the surface and any previously formed word taking the tiles which make such word, the player with the largest number of tiles when all the tiles capable of being used have been used.

PREFERRED FEATURES OF THE INVENTION

In a varied form, at least some of the tiles may be provided with an indicia of bonus values which are added to the score of the player possessing such tiles. Conveniently, the tiles are provided with formations capable of interlocking with one another along one pair of respective parallel side edges of the tiles, so that the letters of a formed word can be held together.

INTRODUCTION TO THE DRAWINGS

The invention will now be described in more detail, by way of examples, with reference to the accompanying diagrammatic drawings, in which:

IN THE DRAWINGS

FIG. 1 shows a playing tile;

FIG. 2 shows a word composed from four playing tiles; and

FIG. 3 shows a playing frame, partially broken away, and with interlocking edge formations.

DESCRIPTION OF FIRST EMBODIMENT

The game uses a number of tiles 1 or elements, each of which bears a letter 2 of the alphabet. Tiles 1 of square shape are shown in the figures but they may equally well be round or hexagonal.

The number of these tiles is not critical but it is desired that the frequency of the letters is based on the known frequency tables of the occurrence of letters in the language in which the game is to be played. It will thus be appreciated, for example, that this frequency can be different for players using European languages than those using the English language.

The majority of the tiles may bear no indicia whatsoever other than the letters concerned. However if required, some or all of the tiles may bear a number to indicate the value of the tile in scoring.

In the practical form of the invention illustrated most of the tiles bear no indicia other than the letter, but the relatively rarely used tiles, Z, J and Q, bear a bonus indicia, scoring 4 or 5 points as shown at 3.

The tiles may be supplied in a container, such as a bag (not shown) having a drawstring, and, if required, the rules of the game can be printed on this or can be separate therefrom but enclosed therewith.

Each tile 1 is provided on one pair of parallel side edges with interfitting formations 4 and 5 allowing the tiles to be interlocked with one another during the formation of the word. The wedge-shaped formation 4 is sized to fit snugly into the dove-tail shaped socket formation 5 formed on the opposite side edge of the tile 1.

The rules of the game as as follows:

RULES

Object

The object of the game is for the players to make and keep possession of tiles making words having a minimum of three letters. The game is completed when all, or as many as possible of the tiles are used. At that time scoring is effected by each player being given one point for the tiles constituting each word in his possession to which can be added, if these are used, the bonus points for the unusual tiles.

Method of Playing the Game

Each player has a handful of tiles, the number being not critical, but, normally, the tiles provided would be divided effectively equally amongst the players. The tiles are held face down.

A first player places one tile face up into the centre of the table or other surface and he is followed by the subsequent players. No player is aware of the tile he is to reveal until it is placed on the table.

When there are at least three tiles on the table, any player who can combine these tiles into a word may call this word and, provided it is deemed to be a word, takes the tiles constituting the word. These tiles are held in the form of the word, face up, in front of the player who took them. Players can decide, before commencing play, methods of deciding as to whether words are acceptable, normally by nominating a dictionary, and can decide whether or not special words, such as surnames and geographical words, will be allowable. It may also be decided, before commencement of play, that simply adding a termination to a word to make it plural is or is not allowable.

The player who has received the tiles constituting the word then commences play by placing a further tile into the centre of the table.

If this tile can be used together with the tiles of any of the completed words held face-up in front of the players, to make another word, as by addition to the word already displayed or by using the letters to make an anagram, then any player can nominate this word and he takes the tiles from the player who previously had the word to make the new word.

Play continues either by making words from the tiles in the centre of the game or by combining the tiles in the centre of the game and those in front of any player.

If, when a tile is displayed, two or more players each concurrently nominate a word, the player nominating the longer word will succeed. If the words are the same or are of the same value, then neither player obtains benefit of the use of the particular tile and it must be used in some other word.

When either all of the tiles have been used of no player can use any of the tiles in the centre of the table to make a word, the game is completed and each player counts the number of tiles in words in front of him and to this adds bonus points, if any, signified on the tiles.

It will be seen that the game of the invention is extremely rapid and that persons with good vocabularies and agile minds can readily make long and complicated words by using anagrams from the letters and words currently in play.

MODIFICATION OF FIRST EMBODIMENT

Although interlocking edge-formations are provided on the tiles, these are not essential for playing the game. The tiles 1 may, for example, be kept in alignment by resting them side-by-side on a horizontal flat surface.

Alternatively, the tiles can be kept in alignment by means of a board shown in FIG. 3 and comprising an elongated, rectangular playing frame 6 having a central elongated slot 7 sized to receive with a neat fit, the tiles 1 of a word of say thirty letters which, in practice, is unlikely to be exceeded during a normal game.

I claim:

1. A word game comprising the steps of:

providing a plurality of tiles to a group of players, each said tile having a letter formed on one face thereof;

dividing said plurality of tiles between said players so that each player has a predetermined number of tiles, not to exceed an equal distribution of the tiles among the players, said tiles being so provided in a face down mode whereby a player does not know the letter of any tile until such tile is exposed during play;

sequentially exposing one tile in the possession of each of the players;

arranging a word having at least three letters from the group of letters sequentially exposed by the players;

continuing the sequentially exposing and arranging of words from the group of letters sequentially exposed by the players and by cannibalizing letters from words previously arranged by any player for forming new words;

continuing the sequential exposing, arranging of words and cannibalizing of letters from words previously arranged by any player for forming new words until the supply of tiles is exhausted and arranged to form words, or no further words are capable of being formed;

adding up a score for each player, determined from the tiles utilized in the arranging of particular words formed by each player; and comparing the scores of each player to determine the highest score.

2. A word game according to claim 1, wherein a word arranged with the largest number of tiles dominates over a shorter word capable of being formed with a number of tiles.

3. A word game according to claim 1, wherein bonus points are assigned to predetermined tiles.

* * * * *